US009873284B2

(12) United States Patent
Rowe

(10) Patent No.: US 9,873,284 B2
(45) Date of Patent: Jan. 23, 2018

(54) DEVICE WITH SLIDABLE RETRACTABLE STAND

(71) Applicant: ACCO Brands Corporation, Zurich, IL (US)

(72) Inventor: Michael D. Rowe, Medway, OH (US)

(73) Assignee: ACCO BRANDS CORPORATION, Lake Zurich, IL (US)

( * ) Notice: Subject to any disclaimer, the term of this patent is extended or adjusted under 35 U.S.C. 154(b) by 0 days.

(21) Appl. No.: 14/455,469

(22) Filed: Aug. 8, 2014

(65) Prior Publication Data

US 2015/0041607 A1 Feb. 12, 2015

Related U.S. Application Data

(60) Provisional application No. 61/863,570, filed on Aug. 8, 2013.

(51) Int. Cl.
*B42F 7/08* (2006.01)
*B42F 7/14* (2006.01)

(52) U.S. Cl.
CPC ..... *B42F 7/145* (2013.01); *B42F 7/08* (2013.01); *B42P 2241/12* (2013.01); *Y10T 29/49* (2015.01)

(58) Field of Classification Search
USPC ..... 248/432, 166, 165, 447, 454, 457, 459, 248/460; 40/124.17, 124.18, 120, 610, 40/780, 786; 206/758, 762, 764, 768, 206/45.2–45.27, 425; 220/757; 229/67.3
See application file for complete search history.

(56) References Cited

U.S. PATENT DOCUMENTS

| | | | | |
|---|---|---|---|---|
| 1,359,662 | A * | 11/1920 | Blyth | 40/748 |
| 1,745,947 | A * | 2/1930 | Mustin | B65D 5/5206 206/45.24 |
| 2,419,823 | A * | 4/1947 | Cross | A47G 1/141 40/753 |
| 2,730,232 | A * | 1/1956 | Coe | B65D 5/5206 206/45.26 |
| 2,979,343 | A | 4/1961 | Cline et al. | |
| 3,224,792 | A | 12/1965 | Vernon | |
| 4,343,105 | A * | 8/1982 | Isaacson | 40/761 |
| 4,622,767 | A * | 11/1986 | Sullivan | 40/120 |
| 6,163,998 | A * | 12/2000 | James | A47G 1/143 40/750 |
| 6,536,803 | B2 | 3/2003 | Masson | |
| 6,892,876 | B1 * | 5/2005 | Aubry | B65D 5/422 206/232 |
| 8,382,059 | B2 * | 2/2013 | Le Gette et al. | 248/460 |
| 8,985,543 | B2 * | 3/2015 | Chen et al. | 248/460 |
| 2003/0213886 | A1 * | 11/2003 | Gilbert | 248/454 |
| 2006/0289611 | A1 | 12/2006 | Yeh | |
| 2007/0163897 | A1 | 7/2007 | Lee | |
| 2013/0213825 | A1 | 8/2013 | Blume et al. | |
| 2014/0291977 | A1 | 10/2014 | Harris et al. | |

* cited by examiner

*Primary Examiner* — Alfred J Wujciak
(74) *Attorney, Agent, or Firm* — Thompson Hine LLP

(57) ABSTRACT

A device with a retractable stand including a device body and a stand panel slidably coupled to the device body. The stand panel is slidably movable between a retracted configuration, wherein the stand panel is generally flat and planar, and an extended configuration wherein the stand panel is not generally flat and planar. When said stand panel is in the extended configuration the stand panel forms a stand to support the device body in an upright position.

17 Claims, 5 Drawing Sheets

DEVICE WITH SLIDABLE RETRACTABLE STAND

This application claims priority to U.S. Provisional Patent Application Ser. No. 61/863,570, filed on Aug. 8, 2013 and entitled DEVICE WITH SLIDABLE RETRACTABLE STAND, the entire contents of which are hereby incorporated by reference.

The present invention is directed to a device with retractable stand, and more particularly, to a device with a stand apparatus which can support the device in an upright position.

BACKGROUND

School and office products, such as filers, notebooks, folders, portfolios, pockets and the like are often utilized to store papers and other loose items. In many cases, it is desired to prop the device up for ease of use, access and/or display.

SUMMARY

The present invention is directed to a device with a stand that can be used to prop the device up for ease of use, access and/or display. More particularly, in one embodiment the invention is a device with a retractable stand including a device body and a stand panel slidably coupled to the device body. The stand panel is slidably movable between a retracted configuration, wherein the stand panel is generally flat and planar, and an extended configuration wherein the stand panel is not generally flat and planar. When said stand panel is in the extended configuration the stand panel forms a stand to support the device body in an upright position.

DETAILED DESCRIPTION

Figure 1:
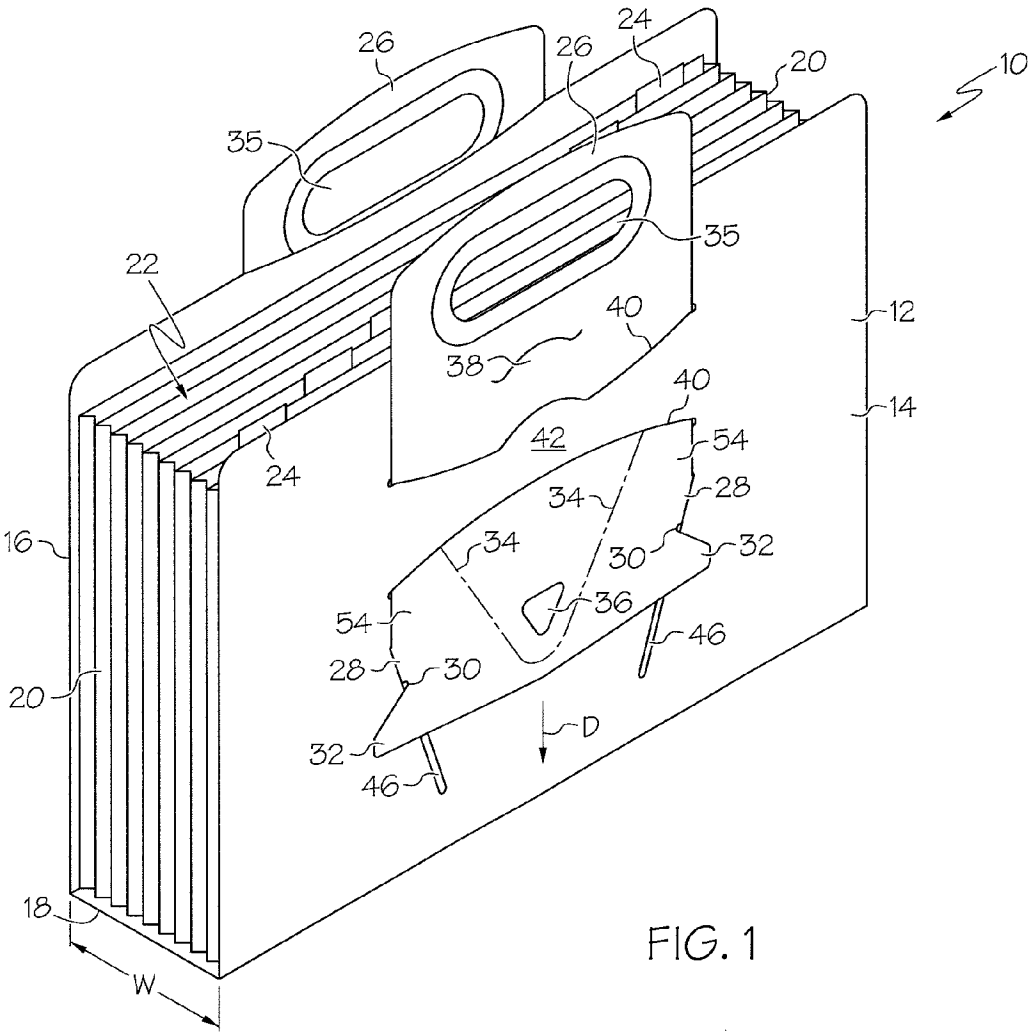
FIG. 1 is a front perspective view of one embodiment of the present invention, with the stand panel in its retracted position.
Figure 5:
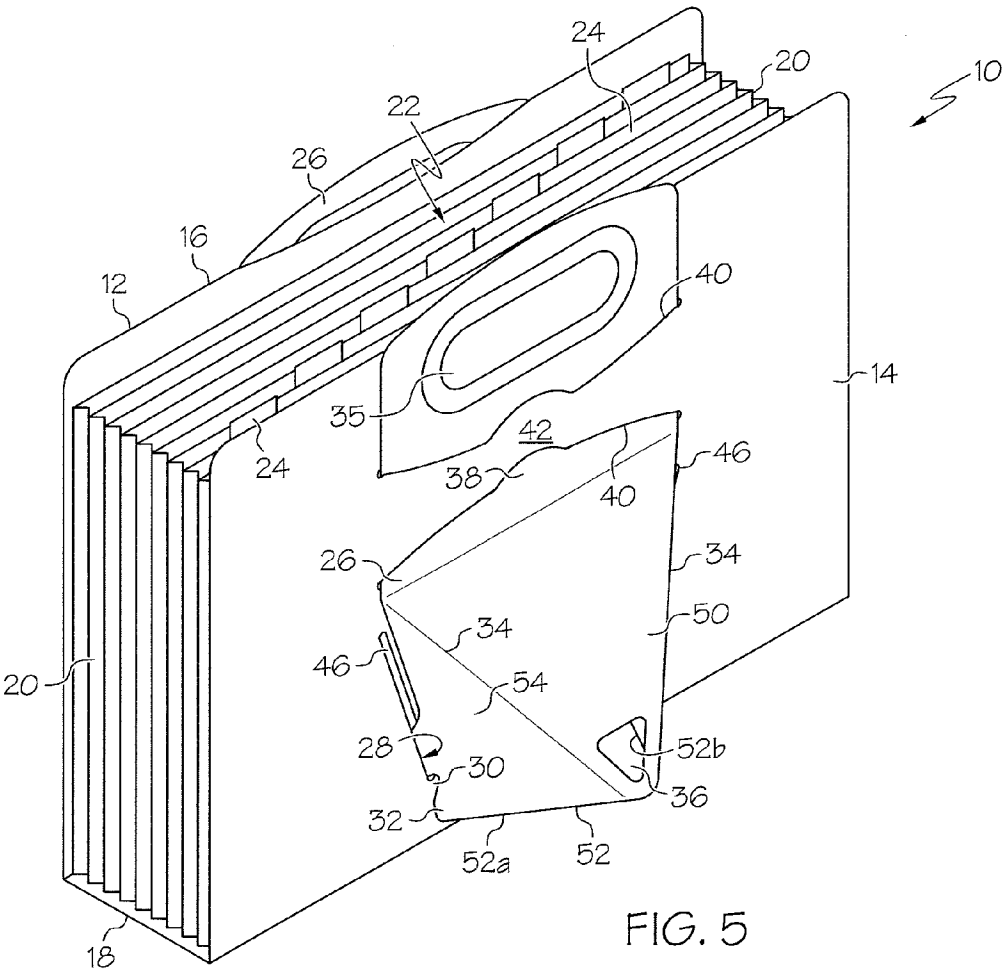
FIG. 5 is a front perspective view of the device of FIG. 1, with the stand panel in its extended position.

With reference to FIGS. 1 and 5, in one embodiment the invention includes or takes the form of a device 10, which can be a school or office product for storing papers, binders, folders, notebooks, writing instruments and other loose items. The device 10 can include but is not limited to filers, pockets, binders, notebooks, folders, portfolios, and the like. In the embodiment shown herein, the device 10 takes the form of an expandable filer including a device body 12 having generally flat, planar, parallel and spaced apart front 14 and back 16 panels, with an optional bottom panel 18 positioned therebetween and generally perpendicular thereto. The front 14, back 16 and bottom 18 panels can be made of a single unitary piece of material with creases/fold lines formed therein to define the front 14, back 16 and bottom 18 panels. However, the panels 14, 16, 18 can instead be formed as separate pieces that are joined together by various means.

The illustrated filer 10 includes a pair of opposed side panels 20 extending between and coupled to the front 14 and back 16 panels. The front panel 14, back panel 16, bottom panel 18 and side panels 20 define a storage cavity 22 therebetween, and a plurality of dividers 24 may be positioned in the storage cavity 22 to aid in filing and organization of items stored therein. In the illustrated embodiment, the side panels 20 are made of an expandable/collapsible accordion-style material, which can allow some expansion/collapsing of the storage cavity 22, although the side panels 20 can also be made of non-expandable material if desired.

The filer 10/device body 12 may include a width w shown in FIG. 1 which, in the illustrated embodiment, extends along the width of the bottom panel 18. It may be desired to position the filer 10 in an upright position in which the filer 10 is supported on the bottom panel 18. In the illustrated embodiment, the width w is relatively small such that the filer 10 may not be able to be stably positioned in the upright position shown in FIG. 1, particularly when the filer 10 stores materials therein which can provide uneven loading, or during use of the filer 10 when items are placed into or removed from the storage cavity 22.

Figure 2:
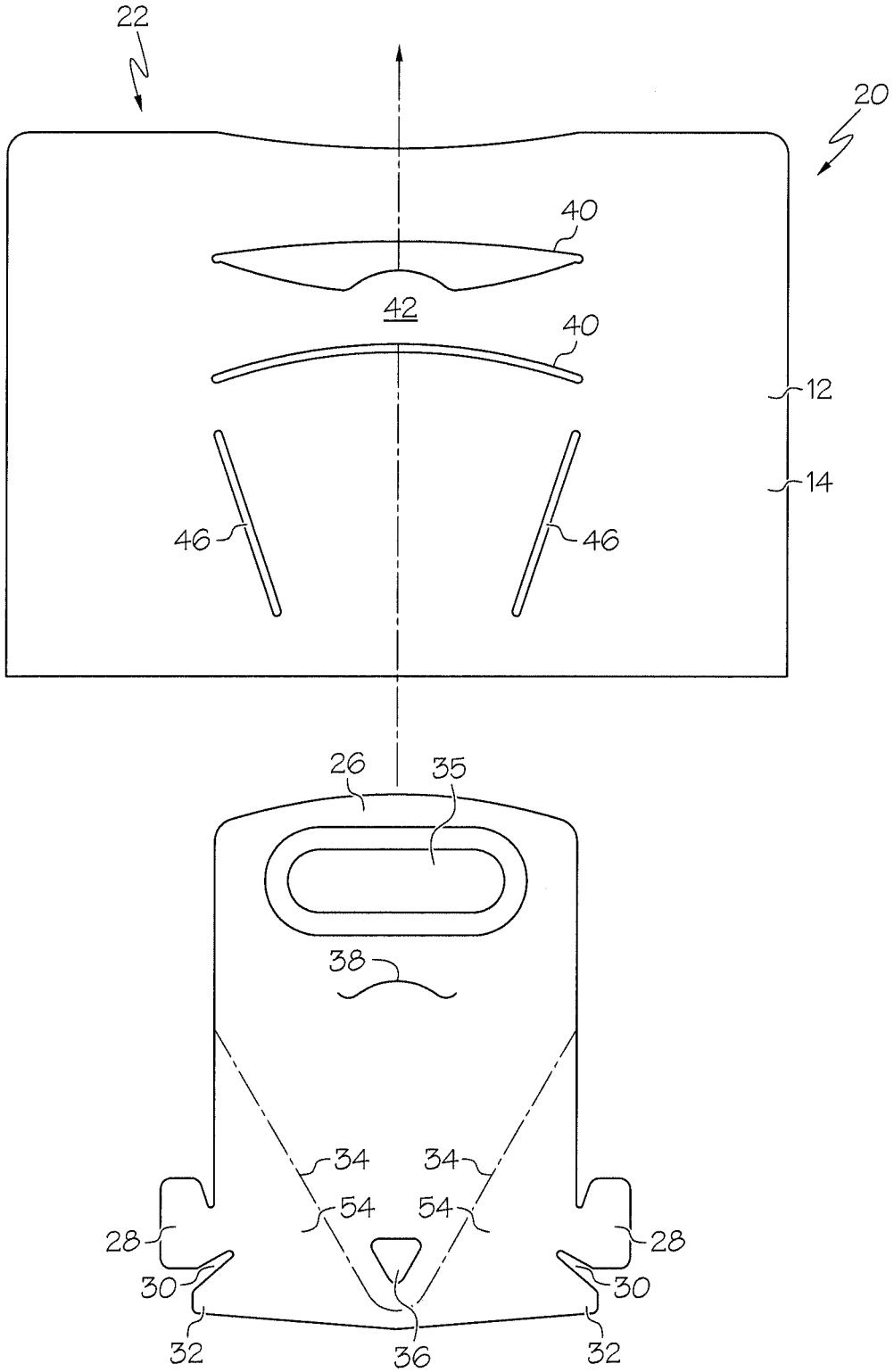
FIG. 2 is a front view of the filer of FIG. 1, with the illustrated side panel exploded away from the device body.

In one embodiment, the device 10 includes a pair of stand panels 26 coupled to the device body 12, and more particularly to an outer panel (the front 14 and/or back panels 16 in the illustrated embodiment). As best shown in FIG. 2, each stand panel 26 may be generally rectangular in front view, and may include a pair of opposed protrusions 28 on either side extending generally outwardly from a lateral side thereof. In the illustrated embodiment, each protrusion 28 is located near a bottom of the stand panel 26 and generally "ear" shaped. Each protrusion 28 is connected to the main body of the stand panel 26 adjacent to a notch 30 formed in the stand panel 26. The stand panel 26 may also include a pair of outwardly-extending retaining flanges 32 at a bottom edge thereof. Each notch 30 is positioned above an associated retaining flange 32, between the associated protrusion 28 and retaining flange 32.

Each stand panel 26 may also include a pair of fold lines or crease lines 34, which can be pre-folded areas of the stand panel 26, or areas/lines of weakness along which the stand panel 26 is pre-disposed to bend when bending forces are applied. In the illustrated embodiment, the stand panel 26 includes a pair of opposed, converging fold lines 34 (with respect to a direction toward a bottom of the stand panel 26), wherein each fold line 34 intersects, in one case, the associated outer edge of the stand panel 26 at an upper end thereof. The fold lines 34 (or an extension thereof) may converge and meet near, but be spaced away from, a bottom edge of the stand panel 26.

Each stand panel 26 can include an upper handle opening 35 and a lower grip opening 36 formed therethrough. Each stand panel 26 may also include a locking flap 38 defined by a generally arcuate cut or slit in the stand panel 26. Each stand panel 26 can take the form of a generally flat, planar component (at least when no external forces are applied thereto and/or when in its retracted position), and can be made of a variety of materials, such as polymers (including plastic), cardboard, polymer-coated cardboard, fabric-covered cardboard or polymer, etc.

Figure 4:
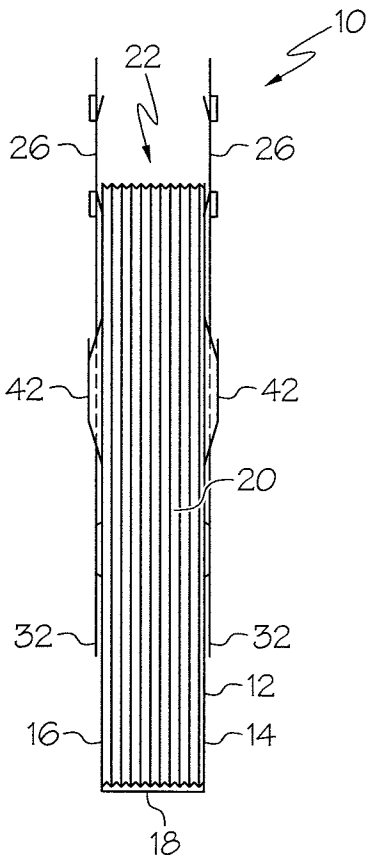
FIG. 4 is a side view of the filer of FIG. 1.
Figure 3:
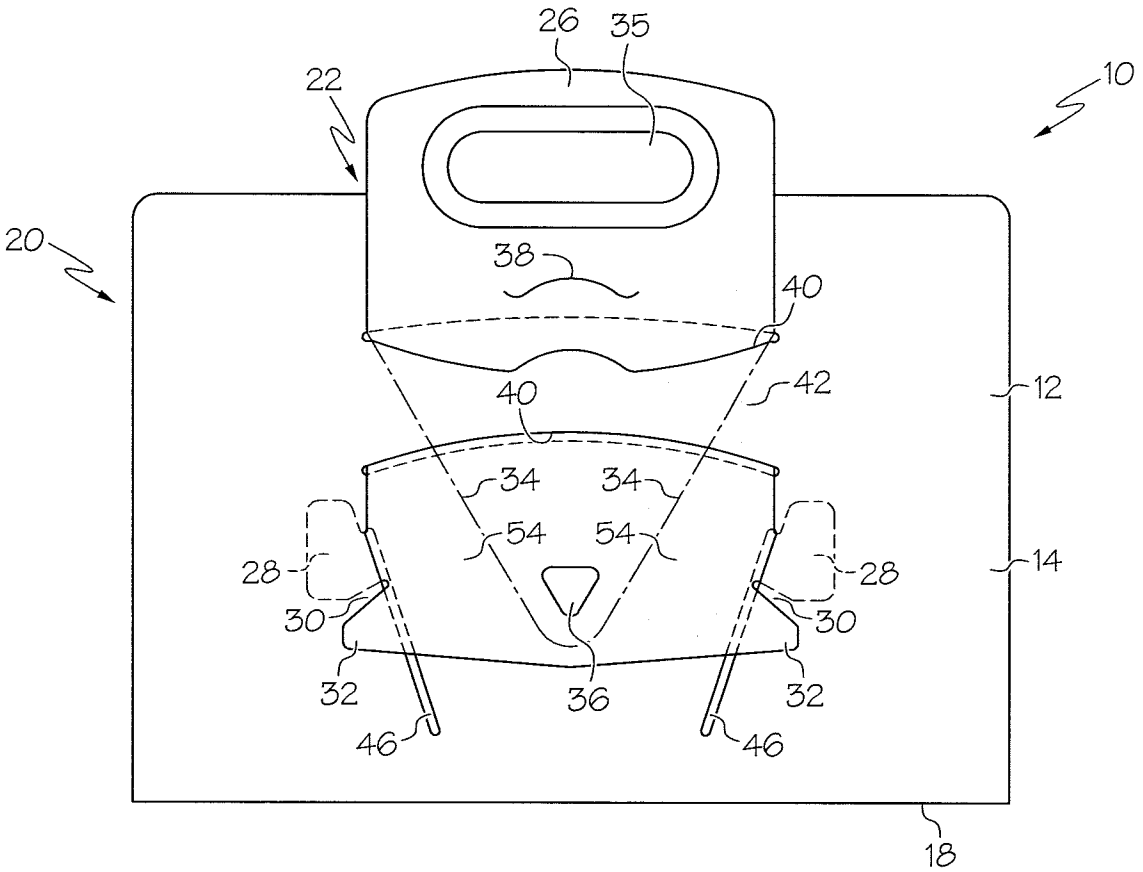
FIG. 3 is a front view of the filer of FIG. 1.

The outer panel of the device body 12 (i.e. the front 14 and/or back 16 panels in the illustrated embodiment) can include a pair of generally parallel primary slits or cutouts 40 formed therein and extending laterally thereacross defining a band 42 therebetween. The outer panel 14/16 may also include a pair of guide slits or cutouts 46 formed therein, wherein the slits 46 converge towards each other as they approach the lower edge of the device body 12. Each slit 46 may be generally parallel with an associated fold line 34 in the stand panel 26 when the stand panel 26 is in the retracted position as shown in FIGS. 1, 3 and 4, and less parallel when the stand panel 26 is in the extended position, as described in greater detail below. However, this generally parallel relationship is not necessarily required.

With reference to FIGS. 1 and 3, each stand panel 26 can be passed through the primary slits 40 of the outer panel 14/16 such that a portion of the stand panel 26 is positioned under the band 42 defined by the two slits 40. In addition, each protrusion 28 of each stand panel 26 can be passed through an associated guide slit 46 such that each protrusion 28 is positioned behind the outer panel 12, 14, in the storage cavity 22. In this manner, the stand panel 26 is slidably coupled to the device body 12/outer panel 14/16, although the stand panel 26 can be slidably coupled to the device 12/outer panel 14/16 in various other manners. In the illustrated embodiment the stand panel 26 is slidably moveable in a direction parallel to a plane of the outer panel 14/16. The retaining flanges 32 remain outside the outer panel 14/16 and the storage cavity 22 (on a side opposite of the protrusions 28) to ensure the stand panel 26 remains in position and slides smoothly over the outer panel 14/16. If desired, a covering material can be positioned on an inside surface of each outer panel 14, 16, covering the slits 46 and the protrusions 28, to protect those components and prevent any items in the storage cavity 22 from getting caught in the slits 46 or on the protrusions 28.

Figure 7:
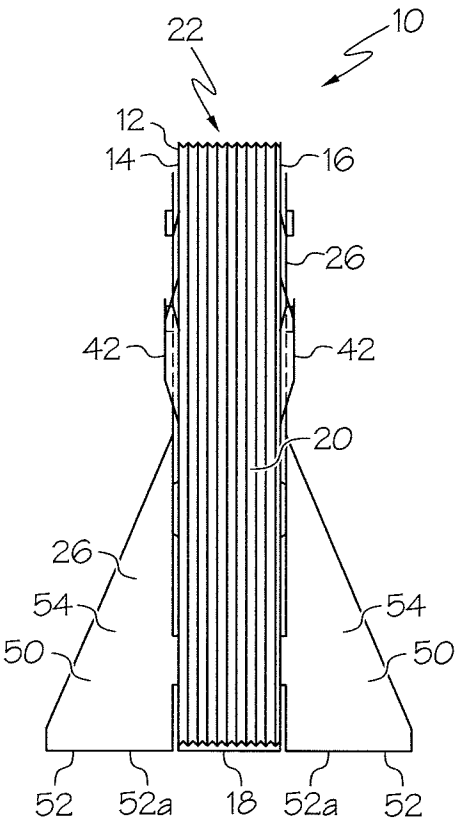
FIG. 7 is a side view of the filer of FIG. 5.
Figure 6:
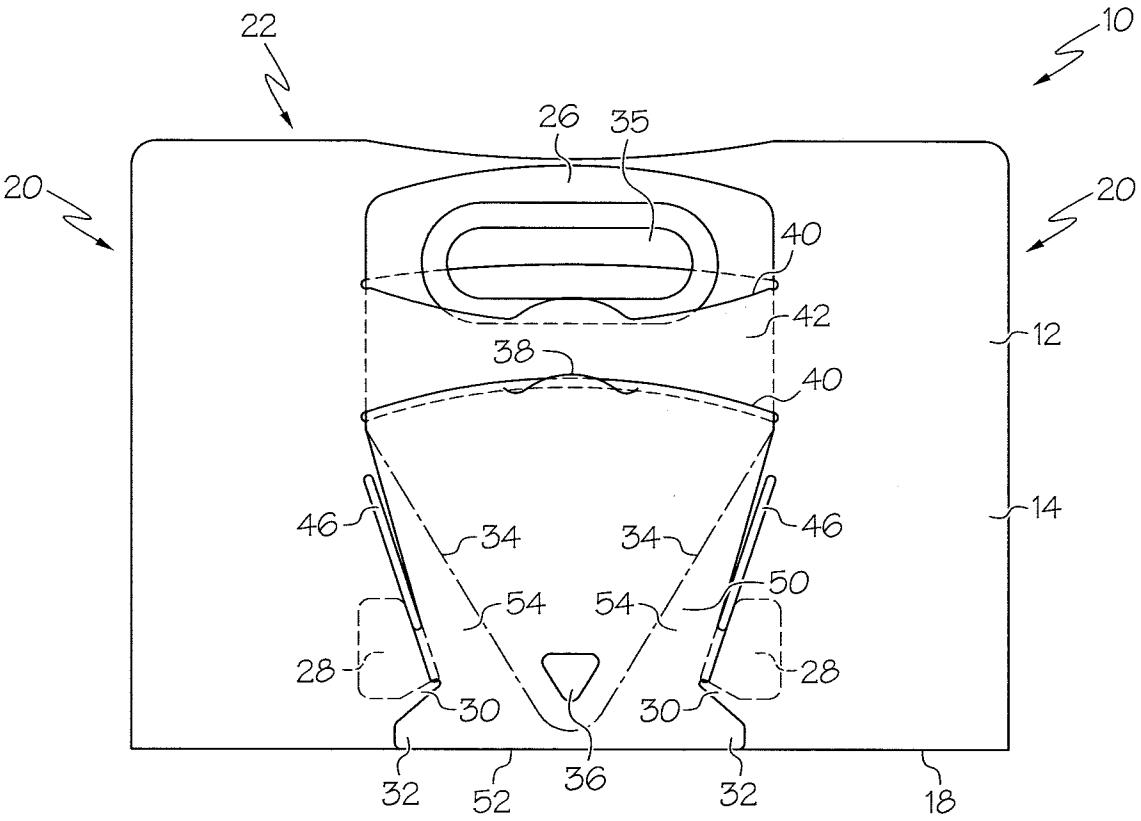
FIG. 6 is a front view of the filer of FIG. 5.

FIGS. 1, 3 and 4 illustrate the stand panels 26 in their upper, or retracted position or configuration. In this position, the hand opening 35 may be positioned above the device body 12 and aligned such that a user can pass his or her hand through the hand openings 35 to carry the device 10. The stand panels 26 can be individually slidably moveable to their lower/extended/deployed positions or configurations, shown in FIGS. 5-7, by applying a downward force, such as a manual downward force, to the stand panel(s) 26, causing the stand panel(s) 26 to slide in a straight line sliding direction D shown in FIG. 1. In one case, a user can pass a finger through the grip opening 36 of a stand panel 26 to pull the stand panel 26 to its lower/extended position, although the downward force can be applied in other manners.

As the stand panel 26 is slid from its retracted position to its extended position, the protrusions 28 cooperate with the slits 46 (during the entire sliding motion) to guide the sliding motion and cause the stand panel 26 to bow outwardly in a direction generally perpendicular to the outer panel 14/16. In particular, as the stand panel 26 is slid to its extended position, the slits 46 apply an inwardly-directed force to the notches 30 of the stand panel 26 positioned below the protrusions 28, due to the narrowing width presented by the converging slit 46. The inwardly-directed force causes the stand panel 26 to bow outwardly along the fold lines 34. The stand panel 26 thereby forms a generally "ramp" shape protrusion 50 as shown in FIG. 5 wherein the protrusion 50 includes a lower edge 52 that extends generally perpendicular to, or at an angle (i.e. non perpendicular and non-parallel angle) relative to, the outer panel 14/16. In this manner, when the stand panel 26 is in its extended position, the stand panel 26 forms a stand to support the device body 12 in an upright position. The lower edge 52 can include two portions 52*a*, 52*b*, that form a generally "V" shape and are both angled (i.e. non perpendicular and non-parallel angle) relative to the plane of the associated outer panel 14/16.

In one embodiment, the lower edge 52 of each protrusion 50 is aligned with the lower edge of the stand body 12/bottom panel 18/outer panel 14, 16 and extends, in a direction perpendicular to the outer panel 14/16, a distance equal to at least about one-quarter of the width w of the device body 12, or in another case, at least about one-half of the width w, and in another case, at least about equal to the width w, to provide sufficient support to the device 10. Conversely, when the stand panel 26 is moved to its upper or retracted position, the lower edge or lower surface 52 of the stand panel 26 may be positioned above the bottom panel 18/lower surface of the device body 12, and may extend, in a direction perpendicular to the outer panel 14/16, a distance less than about one-quarter of the width w of the device body 12, or in another case less than about one tenth of the width w of the device body 12 (i.e. in an amount equal to the thickness of the stand panel 26 in one case). Moreover, the stand panel 26 may extend, in the direction perpendicular to the outer panel 14/16, at least about 5 times or at least about 10 times more when the stand panel 26 is its extended position compared to when the stand panel 26 is in its retracted position.

Each of the fold lines 34 may form an angle (i.e. non perpendicular and non-parallel angle) with the sliding direction D, as may the slits 46. As noted above, the fold lines 34 and slits 46 may be generally parallel such that the bending forces applied to the notch 30 are evenly transmitted to the fold lines 34 to cause the stand panel 26 to bulge outwardly and form the protrusion shape 50 outlined above. Each fold line 34 at least partially defines an adjacent outer flap portion 54, and the stand panel 26 is foldable about the fold lines 34 such that each flap portion 54 forms an angle (i.e. non perpendicular and non-parallel angle) with a main portion of the stand panel 26 when the stand panel 26 is in its extended position. Each flap portion 54 may also be positioned at an angle (i.e. non perpendicular and non-parallel angle) relative to the outer panel 14/16 when the stand panel 26 is in its extended position, and be generally parallel with the outer panel 14/16 when the stand panel 26 is in its retracted position. However, in one case, the stand panel 26 may lack the fold lines 34, and the stand panel 26 may be made of sufficiently flexible material that the stand panel 26 naturally bulges/deforms to form the protrusion shape 50 when the stand panel 26 is moved to its lower/extended position.

When the stand panel 26 is in its extended position, the retaining flap 38 can be positioned in front of the band 42 (see FIGS. 5 and 6) to temporarily lock the stand panel 26 in place, and prevent the stand panel 26 from being moved to its retracted position. Of course, various other means or mechanisms can be utilized to lock the stand panel 26 in place, such as snaps, clasps, other inter-engaging features, hook-and-loop fastening material, magnets etc. In addition, in some cases no retaining features are required, and the stand panel 26 may remain in place simply by frictional or other forces.

When it is desired to return the stand panel 26 to its upper or retracted position, the retaining flap 38 (if utilized) is positioned behind the band 42, and the stand panel 26 is moved upwardly utilizing, if desired, the hand opening 35 and/or grip opening 36. The sliding interaction between the slots 46 and protrusions 28 causes the stand panel 26 to return to its planar position, as urged by its material properties (e.g. a natural inclination to return to a flat shape) and/or the slot 46/protrusion 28 configuration.

The illustrated embodiment shows the filer 10 with a stand panel 26 coupled to either side 14, 16 thereof. However, in one embodiment, only a single stand panel 26 can be coupled to the filer 10. Moreover, in the illustrated embodiment the stand panel 26 includes a pair of opposed protrusions 28, each of which is received in a corresponding slit 46. However, it may also be possible to utilize only a single protrusion 28 which slides within a single slit 46 to cause the stand panel 26 to move to its extended position. In addition, the disclosed position of the protrusions 28 and slits 46 may be reversed. In particular, one or more protrusions 28 can be positioned on the device body 12/outer panel 14/16, and one or more slits 46 can be positioned on the stand body 26.

If desired, certain areas of the outer panel 14/16 adjacent to the slits 46 can be reinforced. For example, in one case a reinforcing material (not shown) is coupled to an inner surface of the outer panel 14/16 to strengthen areas of the outer panel 14/16 surrounding the slits 46.

Thus, the device 10 disclosed herein can utilize the sliding stand panels 26 which are relatively easy to manufacture and assemble, are easy and intuitive to operate, and provide a stabilizing feature when deployed without any buttons, snaps, hook-and-loop fastening material or other mechanical components in one embodiment.

Having described the invention in detail and by reference to the various embodiments, it should be understood that modifications and variations thereof are possible without departing from the scope of the claims of the present application.

What is claimed is:

1. A device with a retractable stand for propping the device upon a surface, the device comprising:

a device body having a pair of outer panels that are substantially parallel with respect to one another, wherein the panels are connected each other by a bottom panel, each panel including a pair of slots formed therein; and a pair of stand panels that are each slidably coupled to the device body at one of said pair of outer panels to position said device into an upright position that is substantially perpendicular with respect to the surface, wherein each slot of each of said pair of outer panels of said device body receives at least part of the corresponding stand panel therethrough to slidably couple said corresponding stand panel to said device body, wherein the corresponding stand panel is constructed of a single, unitary piece of material that is a separate component from the device body and is slidably movable between a retracted configuration, wherein said corresponding stand panel is generally flat and planar, and an extended configuration wherein said corresponding stand panel is not generally flat and planar, wherein when said corresponding stand panel is in said extended configuration said corresponding stand panel positions said device into the upright position, and at least one of said device body or said corresponding stand panel includes a slit or opening, wherein at least part of the other one of said device body or said corresponding stand panel is received through said slit or opening to slidably couple said corresponding stand panel to said device body.

2. The device of claim 1 wherein said at least part of the other one of said device body or said corresponding stand panel moves within said slit or opening when said corresponding stand panel moves between said extended configuration and said retracted configuration.

3. The device of claim 2 wherein said at least part of the other one of said device body or said corresponding stand panel remains within said slit or opening for an entire range of motion when said corresponding stand panel moves between said extended configuration and said retracted configuration.

4. The device of claim 1 wherein when said corresponding stand panel is in said extended configuration said corresponding stand panel has a lower edge in a generally "V" shaped configuration, and wherein said generally "V" shaped edge is configured to engage a support surface along its perimeter thereof.

5. The device of claim 1 wherein at least part of said corresponding stand panel extends generally perpendicular to a corresponding outer panel when said corresponding stand panel is in said extended configuration.

6. The device of claim 5 wherein said device body has a width that extends generally perpendicular to said corresponding outer panel when said corresponding stand panel is in said retracted configuration, and wherein when said corresponding stand panel is in said extended configuration said corresponding stand panel extends perpendicular to said corresponding outer panel a distance equal to at least about ¼ of said width of said device body.

7. The device of claim 1 wherein said corresponding stand panel is slidably movable in a direction parallel to a plane of a corresponding outer panel to cause said corresponding stand panel to move between said retracted configuration and said extended configuration.

8. The device of claim 1 wherein said device body includes a lower surface, and wherein said corresponding stand panel includes a lower surface that is generally aligned with said lower surface of said device body when said corresponding stand panel is in said extended configuration.

9. The device of claim 8 wherein said lower surface of said corresponding stand panel is positioned above said lower surface of said device body when said corresponding stand panel is in said retracted configuration.

10. The device of claim 1 wherein said corresponding stand panel includes a fold line defining a flap portion therein, and wherein said device is configured such that said flap portion is not folded about said fold line when said corresponding stand panel is in said retracted configuration, and wherein said flap portion is folded about said fold line when said corresponding stand panel is in said extended configuration such that said flap portion forms an angle with a main portion of said corresponding stand panel.

11. The device of claim 10 wherein said corresponding stand panel is slidably movable in a sliding direction along a straight line, and wherein said fold line forms an angle with said sliding direction.

12. The device of claim 1 further comprising a retaining feature to retain the corresponding stand panel in the extended configuration.

13. The device of claim 1 wherein said device body includes generally parallel and spaced apart side panels and a bottom panel, wherein said said pair of outer panels, said side panels and bottom panel define a storage cavity therebetween.

14. A device with a retractable stand for propping the device upon a surface, the device comprising:

a device body having a pair of outer panels that are substantially parallel with respect to one another, wherein the panels are connected each other by a bottom panel, each panel including a pair of slots formed therein; and a pair of stand panels that are each slidably coupled to the device body at one of said pair of outer panels to position said device into an upright position that is substantially perpendicular with respect to the surface, wherein each slot of each of said pair of outer panels of said device body receives at least part of said corresponding stand panel therethrough to slidably couple the corresponding stand panel to said device body, wherein the corresponding stand panel is constructed of a single, unitary piece of material that is a separate component from the device body and is slidably movable between a retracted configuration, wherein said corresponding stand panel is generally flat and planar, and an extended configuration wherein said corresponding stand panel is not generally flat and planar, wherein when said corresponding stand panel is in said extended configuration said corresponding stand panel forms a stand to support said device body in an upright position, wherein at least one of said device body or said corresponding stand panel includes a slit or opening formed therein, and wherein the other one of said device body or said corresponding stand panel includes a protrusion received in said slit or opening, and wherein device is configured such that as said corresponding stand panel is slidably moved in a predetermined direction from said retracted configuration said slit or opening and said protrusion cooperate to cause said corresponding stand panel to move to said extended configuration.

15. The device of claim 14 wherein said predetermined direction is a straight line in a plane of said device body or corresponding stand panel, and wherein said slit or opening forms an angle with said straight line.

16. The device of claim 14 wherein at least one of said device body or said corresponding stand panel includes a supplemental slit or opening formed therein, and wherein the other one of said device body or said corresponding stand panel includes a supplemental protrusion received in said supplemental slit or opening, and wherein said device is configured such that as said corresponding stand panel is slidably moved in said predetermined direction said supplemental slit or opening and said supplemental protrusion cooperate to cause said corresponding stand panel to move to said extended configuration.

17. The device of claim 16, wherein said slit and said supplemental slit converge along said predetermined direction.

* * * * *